US007028668B1

(12) United States Patent
West et al.

(10) Patent No.: US 7,028,668 B1
(45) Date of Patent: Apr. 18, 2006

(54) SELF-DAMPING FUEL RAIL

(75) Inventors: David West, Milford, MI (US); Michael T. Streb, Plymouth, MI (US); William M. Warner, Summerville, SC (US)

(73) Assignee: Robert Bosch GmbH, (DE)

( * ) Notice: Subject to any disclaimer, the term of this patent is extended or adjusted under 35 U.S.C. 154(b) by 0 days.

(21) Appl. No.: 11/019,076

(22) Filed: Dec. 21, 2004

(51) Int. Cl.
*F02M 55/02* (2006.01)

(52) U.S. Cl. ..... 123/456; 123/468; 123/469

(58) Field of Classification Search ..... 123/456, 123/468, 469; 138/26
See application file for complete search history.

(56) References Cited

U.S. PATENT DOCUMENTS

| | | | | |
|---|---|---|---|---|
| 4,457,280 | A | 7/1984 | Hudson, Jr. | |
| 4,474,160 | A | 10/1984 | Gartner | |
| 4,519,368 | A | 5/1985 | Hudson, Jr. | |
| 4,570,600 | A | 2/1986 | Atkins et al. | |
| 4,660,524 | A | 4/1987 | Bertsch et al. | |
| 5,022,372 | A | 6/1991 | Imura et al. | |
| 5,024,198 | A | 6/1991 | Usui | |
| 5,027,777 | A | 7/1991 | De Bruyn et al. | |
| 5,090,385 | A | 2/1992 | Usui et al. | |
| 5,211,149 | A | 5/1993 | DeGrace et al. | |
| 5,617,827 | A | 4/1997 | Eshleman et al. | |
| 6,148,798 | A | 11/2000 | Braun et al. | |
| 6,205,979 | B1 | 3/2001 | Sims, Jr. et al. | |
| 6,354,273 | B1 | 3/2002 | Imura et al. | |
| 6,371,083 | B1 | 4/2002 | Rossi et al. | |
| 6,418,909 | B1 | 7/2002 | Rossi et al. | |
| 6,418,910 | B1 | 7/2002 | Nally et al. | |
| 6,427,665 | B1 * | 8/2002 | Knoedl et al. | 123/456 |
| 6,463,911 | B1 | 10/2002 | Treusch et al. | |
| 6,470,859 | B1 | 10/2002 | Imura et al. | |
| 6,497,128 | B1 | 12/2002 | Canfield et al. | |
| 6,497,219 | B1 | 12/2002 | Natsume | |
| 6,513,500 | B1 | 2/2003 | Braun et al. | |
| 6,513,501 | B1 | 2/2003 | Schwegler et al. | |
| 6,672,286 | B1 * | 1/2004 | Miandoab et al. | 123/456 |
| 6,889,660 | B1 * | 5/2005 | Usui et al. | 123/456 |
| 6,901,914 | B1 * | 6/2005 | Becene et al. | 123/456 |
| 2001/0042538 | A1 | 11/2001 | Rossi et al. | |
| 2002/0053341 | A1 | 5/2002 | Imura et al. | |
| 2002/0083924 | A1 | 7/2002 | Murphy | |
| 2002/0108660 | A1 | 8/2002 | Braun | |
| 2003/0019477 | A1 | 1/2003 | Bodenhausen et al. | |
| 2003/0056759 | A1 | 3/2003 | Davey | |
| 2004/0226540 | A1 * | 11/2004 | Kreschel et al. | 123/456 |

FOREIGN PATENT DOCUMENTS

| | | |
|---|---|---|
| DE | 40 06 501 A 1 | 9/1991 |
| JP | 3-179162 | 8/1991 |

* cited by examiner

*Primary Examiner*—Thomas Moulis
(74) *Attorney, Agent, or Firm*—Michael Best & Friedrich LLP

(57) ABSTRACT

A fuel rail for a fuel-injected internal combustion engine includes an elongated tube having a longitudinal axis, an overall length and a cross-sectional shape along a substantial portion of the length of the tube. The cross-sectional shape is a closed curve, wherein all portions of the cross-sectional shape curve outwardly from the longitudinal axis, and the shape has a non-constant radius. The fuel rail also includes at least one fuel outlet for communicating with a fuel injector.

35 Claims, 5 Drawing Sheets

SELF-DAMPING FUEL RAIL

FIELD OF THE INVENTION

The invention relates to fuel rails for a fuel system of an internal combustion engine, and more particularly to a self-damping fuel rail for damping pressure pulsations created by the fuel injectors.

BACKGROUND OF THE INVENTION

In fuel injection systems, pressure pulsations within the fuel system, and in particular a fuel rail, can cause various problems. For example, internal pressure pulsations within a fuel rail tube of an automotive fuel injection system can result in audible noise, and can adversely affect tailpipe emissions and driveability. It is known to use self-damping fuel rails in the fuel injection system to solve these problems.

SUMMARY OF THE INVENTION

The present invention provides a fuel rail for a fuel-injected internal combustion engine. The fuel rail includes an elongated tube including a longitudinal axis, an overall length, and a cross-sectional shape along a substantial portion of the length of the tube. The cross-sectional shape is a closed curve, wherein all portions of the cross-sectional shape curve outwardly from the longitudinal axis, and the cross-sectional shape has a non-constant radius. The fuel rail also includes at least one fuel outlet for communicating with a fuel injector.

In a further embodiment of the invention, the radius of the tube varies adjacent the fuel outlet. In another embodiment of the invention, the tube includes a first axis perpendicular to the longitudinal axis with the cross-sectional shape symmetrical about the first axis. The tube may further include a second axis perpendicular to the longitudinal axis and the first axis with the cross-sectional shape symmetrical about the first and second axes. In still a further embodiment of the invention, the cross-sectional shape is substantially elliptical.

The present invention also provides a fuel supply system for a fuel-injected internal combustion engine. The fuel supply system includes a fuel rail including a longitudinal axis and a substantially elliptical cross-sectional shape with the fuel rail further including a sidewall defining a chamber and first and seconds ends. The fuel supply system also includes at least one fuel outlet formed in the sidewall for communicating with a fuel injector and a fuel injector cup in communication with the fuel outlet and the chamber.

In a further embodiment of the invention, the fuel rail has a thickness wherein the thickness adjacent the fuel injector is greater than the thickness of the remaining portions of the fuel rail.

In a further embodiment of the invention, the fuel supply system includes a second fuel rail including a longitudinal axis and having a substantially elliptical cross-sectional shape, the second fuel rail further including a sidewall defining a chamber and first and second ends. At least one fuel outlet is formed in the sidewall of the second fuel rail for communicating with a fuel injector. Further, a fuel conduit communicates with the chamber of the first fuel rail and the chamber of the second fuel rail.

The present invention further provides a method for fabricating a fuel rail for a fuel-injected internal combustion engine. The method includes providing an elongated tube and forming the tube to have a non-constant radius such that a cross-sectional shape of the tube is a closed curve, wherein all portions of the cross-sectional shape curve outwardly.

In a further embodiment of the invention, the tube is formed by rolling, whereas in another embodiment of the invention, the tube is formed by flattening.

Other features and advantages of the invention will become apparent to those skilled in the art upon review of the following detailed description, claims, and drawings.

Figure 1:
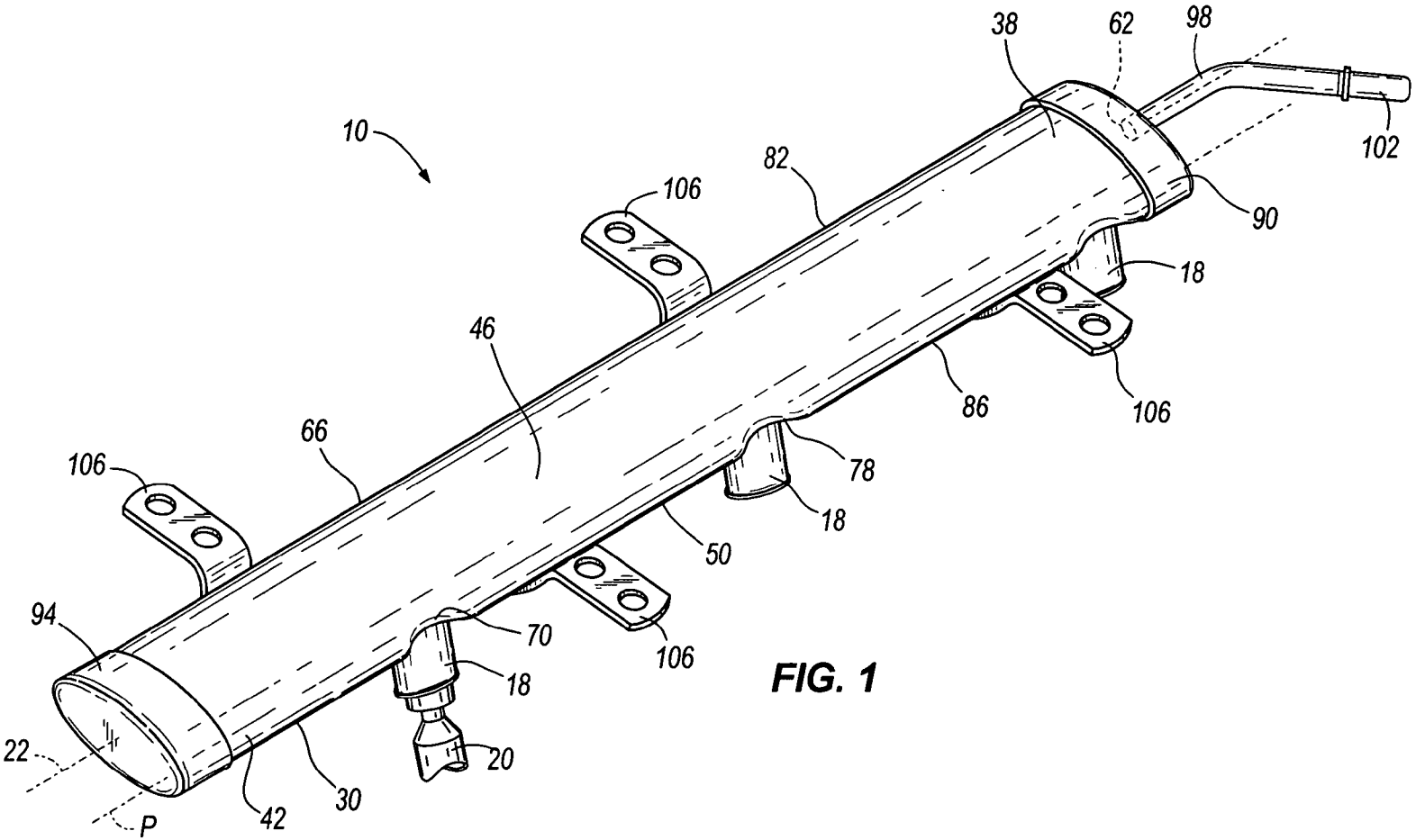
FIG. 1 is a perspective view of a fuel rail embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein with reference to element orientation (such as, for example, terms like "top", "bottom", "side", etc.) are only used to simplify description of the present invention, and do not alone indicate or imply that the element referred to must have a particular orientation. In addition, terms such as "first" and "second" are used herein for purposes of description and are not intended to indicate or imply relative importance or significance. The use of "including", "having" and "comprising" and variations thereof herein is meant to encompass the items listed thereafter and equivalents thereof as well as additional items.

DETAILED DESCRIPTION OF THE PREFERRED EMBODIMENT

FIG. 1 is a perspective view of a fuel rail assembly 10 for use in a fuel-injected internal combustion engine. The fuel rail assembly 10 includes a self-damping fuel rail 14 and a plurality of fuel injector cups 18 coupled to the fuel rail 14. Each fuel injector cup receives a fuel injector 20. The illustrated fuel rail 14 is configured to contain fuel pressurized from about 4 bar to about 8 bar above the ambient pressure, however further embodiments of the fuel rail may be configured to contain fuel pressurized to about 150 bar. The fuel rail 14 embodying the invention is self-damping for damping pressure pulsations in the fuel that are created by operation of the fuel injectors 20, and therefore does not require use of a separate internal or external damping device. The fuel rail 14 is tunable over a larger range of frequencies, and therefore shows less sensitivity to tuning and exhibits lower overall stress in the material comprising the fuel rail 14.

FIGS. 2–7 illustrate the fuel rail assembly 10 in more detail. The fuel rail 14 includes a longitudinal axis 22 and a cross-sectional shape 26 along a substantial portion of the overall length of the fuel rail 14. The fuel rail 14 also includes a sidewall 30 defining a chamber 34, a first end 38, a second end 42, a top exterior surface 46, and a bottom exterior surface 50. In the illustrated embodiment, the cross-sectional shape 26 (shown in FIG. 3) has a non-constant radius and is a closed curve wherein all portions of the cross-sectional shape 26 curve outwardly from the longitudinal axis 22. The cross-sectional shape 26 is convexly-contoured and does not include concave or flat portions.

The tube has a first axis 54 perpendicular to the longitudinal axis 22 and a second axis 58 perpendicular to the longitudinal axis 22 and the first axis 54. In a preferred embodiment of the invention, the cross-sectional shape 26 is symmetrical about the first axis 54 and the second axis 58. In still another preferred embodiment of the invention, the cross-sectional shape 26 is elliptical (shown in FIG. 3). It should be understood that many other shapes are possible for the fuel rail 14.

Figure 3:
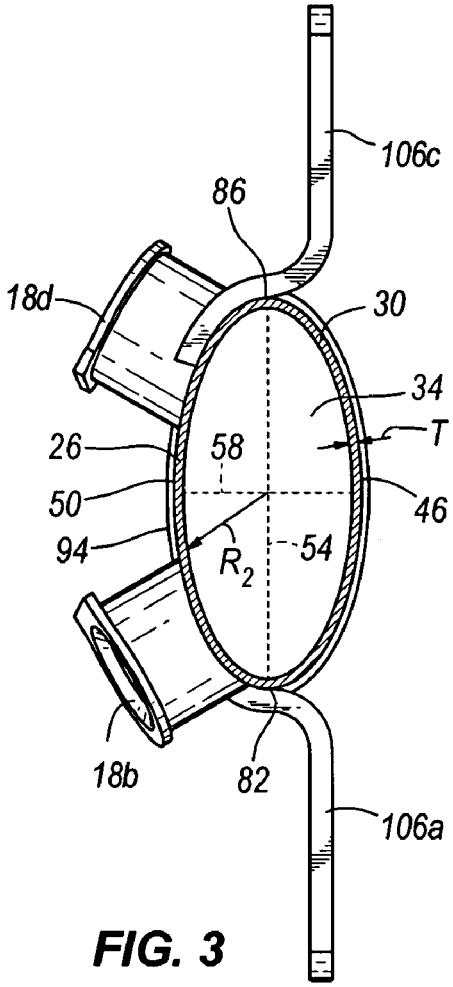
FIG. 3 is a section view taken along line 3—3 of FIG. 2.

In the illustrated embodiment of the invention, the whole fuel rail 14 has a thickness T between about 0.8 mm and about 1.5 mm (shown in FIG. 3). In general, as the diameter of the cross-sectional shape 26 of the fuel rail 14 increases, the thickness T of the fuel rail 14 increases. Thus, in other embodiments of the invention, the thickness T of the fuel rail 14 is less than 0.8 mm or greater than 1.5 mm.

As illustrated in FIG. 3, the fuel rail 14 has a major diameter along the first axis 54 between about 41 mm and about 43 mm and a minor diameter along the second axis 58 between about 18 mm and about 21 mm. In general, the ratio between the major and minor diameters of a particular fuel rail will vary depending upon the engine used and the fuel pressure created within the fuel rail. Therefore, in other embodiments of the invention, the ratio between the major and minor diameters of the fuel rail 14 will vary depending upon the system parameters for a particular fuel-injected engine.

The cross-sectional shape 26 of the fuel rail 14 reduces pressure pulsations within the fuel rail 14. As compared to prior art fuel rails having an oval cross-sectional shape with flat surfaces, the cross-sectional shape 26 of the fuel rail 14 has a more gradual transition from more curved to less curved surfaces of the fuel rail 14, which reduces stress in the fuel rail 14. Curved surfaces are stronger and stiffer than flat surfaces due to an increase in the bending moment. The transverse stiffness (i.e., in-plane stiffness transverse to the longitudinal axis of the fuel rail) in the curved cross-sectional shape 26 couples with the bending stiffness of the fuel rail 14 for a more rigid fuel rail as compared to oval prior art fuel rails. Therefore, the fuel rail 14 having the cross-sectional shape 26 experiences less deflection under the same pressure as prior art fuel rails having an oval cross-sectional shape. The fuel rail 14 distributes stress from fuel pressure pulsations over a larger area than prior art fuel rails with improved absorption of the pressure pulsations and reduced noise within the fuel injection system.

Further, the cross-sectional shape 26 includes a larger interior rail volume, as compared to prior art fuel rails having an oval cross-sectional shape. The larger volume of the fuel rail 14 also aids in distributing stress from fuel pressure pulsations in the fuel rail 14 over a larger area than prior art fuel rails, and combined with the flexible sidewall 30, reduces the pressure pulsations returned to a fuel inlet 62. The cross-sectional shape 26 of the fuel rail 14 results in damping of the fuel rail 14 over a wider range of frequencies and improves the fatigue life of the fuel rail 14.

The fuel rail 14 is fabricated using an elongated tube 66 that has a substantially circular cross-sectional shape, however, in further embodiments of the invention tubes having other shapes may be used. The tube is formed or processed to have the desired shape, i.e., until the cross-sectional shape 26 has a non-constant radius such that the cross-sectional shape 26 of the fuel rail 14 is a closed curve with all portions of the cross-sectional shape 26 curving outwardly. The cross-sectional shape 26 of the tube is formed by roll-forming, although in further embodiments of the invention, flattening, hydro-forming, or other known processes in the art are used to form the cross-sectional shape to its desired shape.

The elongated tube 66 is comprised of stainless steel, such as 300 series stainless steel, available from Central Steel (Detroit, Mich.), which has a long fatigue life, does not leak or corrode, and is recyclable. Chrome and nickel may be added to the steel for corrosion resistance and strength. In further embodiments of the invention, different types of stainless steel form the tube 66 or the tube 66 is plated with another material, such as zinc or chromium.

Figure 2:
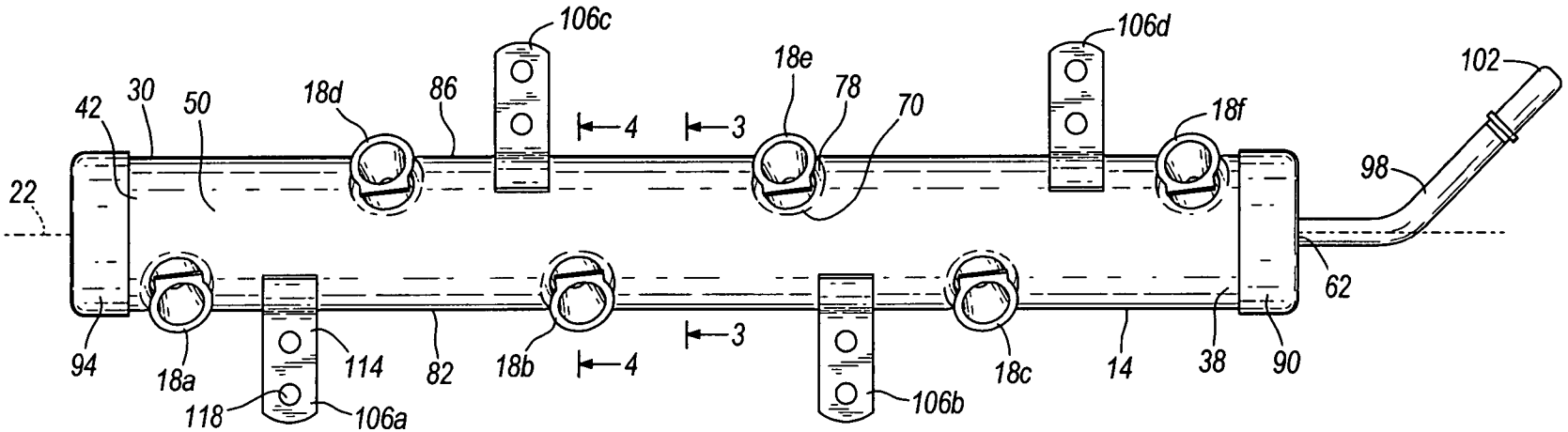
FIG. 2 is a bottom view of the fuel rail.

As illustrated in FIG. 2, the fuel injector cups 18 are coupled to the bottom exterior surface 50 of the fuel rail 14 for communicating with the chamber 34. Fuel outlets 70, for receiving and communicating with the fuel injector cups 18, are formed in the sidewall 30 of the fuel rail 14. Each fuel outlet 70 includes a hole 74 formed in the sidewall 30, for example, by stamping, piercing, punching, or other methods known in the art, and an outer periphery 78 that is a portion of the fuel rail sidewall 30. The fuel injector cups 18 are press-fit into the holes 74 of the fuel outlets 70, such that the fuel injector cups 18 are seated on the fuel outlets 70, and welded into place. Fuel injectors 20 (shown in FIG. 1) are coupled to fuel cups 18 for communicating with the chamber 34 of the fuel rail 14.

Figure 5:
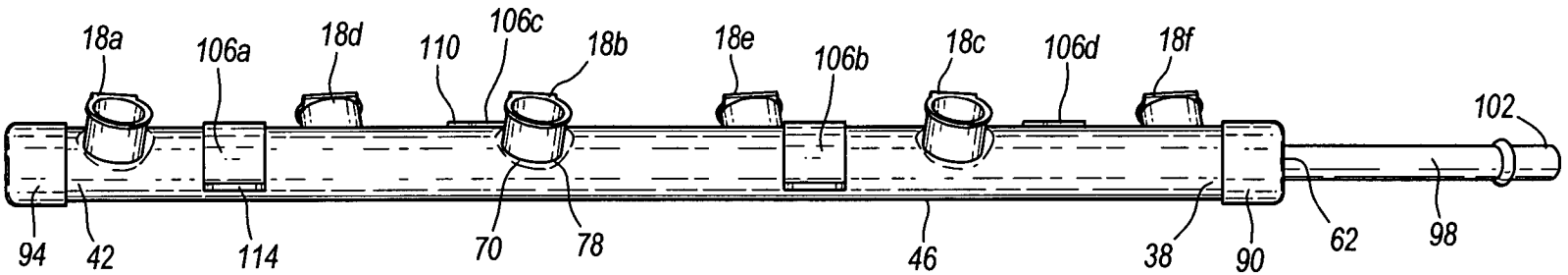
FIG. 5 is a side view of the fuel rail.

The illustrated embodiment of the fuel rail 14 is for use with a six-cylinder engine and includes six fuel injector cups 18 coupled to the fuel rail 14. As illustrated in FIGS. 2 and 5, three fuel injector cups 18*a*, 18*b*, and 18*c* are positioned on a first side portion 82 of the fuel rail 14 at the bottom exterior surface 50 and are spaced equidistantly apart. Three more fuel injector cups 18*d*, 18*e*, and 18*f* are positioned on a second, opposite side portion 86 of the fuel rail 14 at the bottom exterior surface 50. The fuel injector cups 18*d*–18*f* are spaced equidistantly apart from each other and staggered relative to the fuel injector cups 18*a*–18*c* on the first side portion 82. In further embodiments of the invention, fewer or more fuel injector cups 18 are coupled to the fuel rail 14 or the fuel injector cups 18 are arranged in other configurations on the bottom exterior surface 50 of the fuel rail 14, such as aligned, staggered, or spaced equidistantly.

Figure 4:
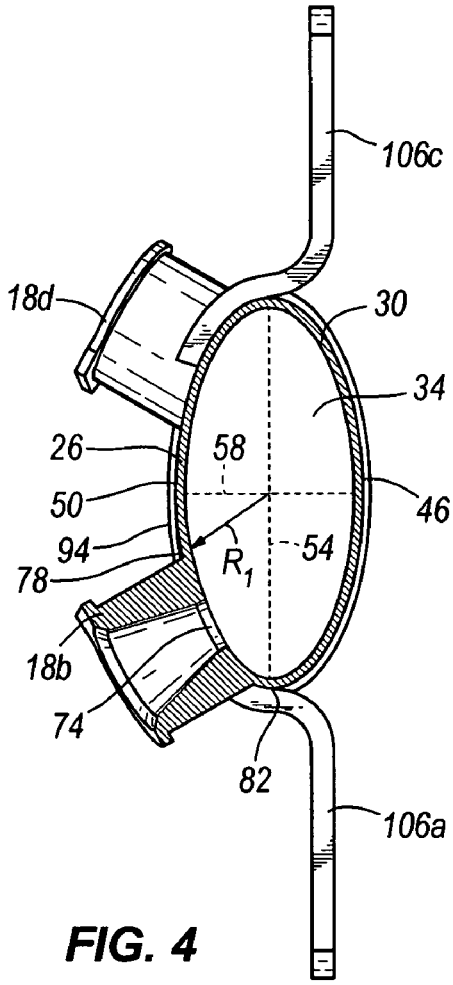
FIG. 4 is a section view taken along line 4—4 of FIG. 2.
Figure 7:
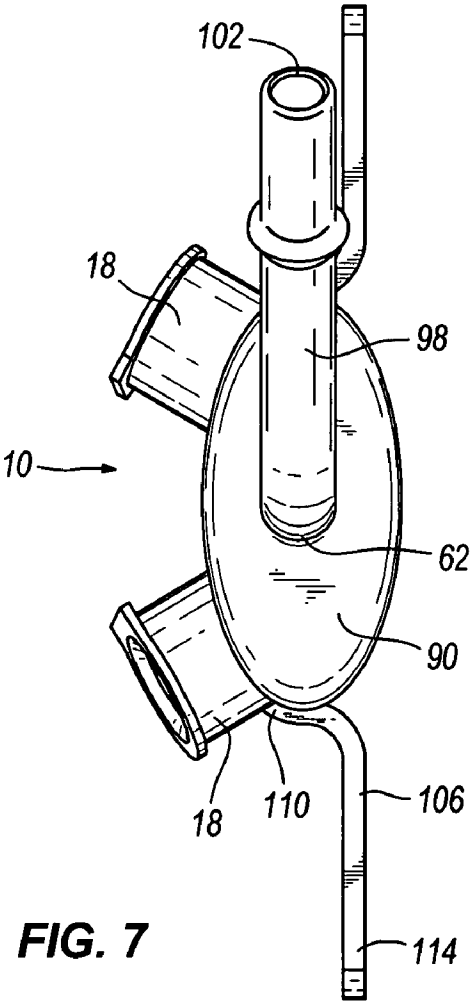
FIG. 7 is an end view of the fuel rail.
Figure 6:
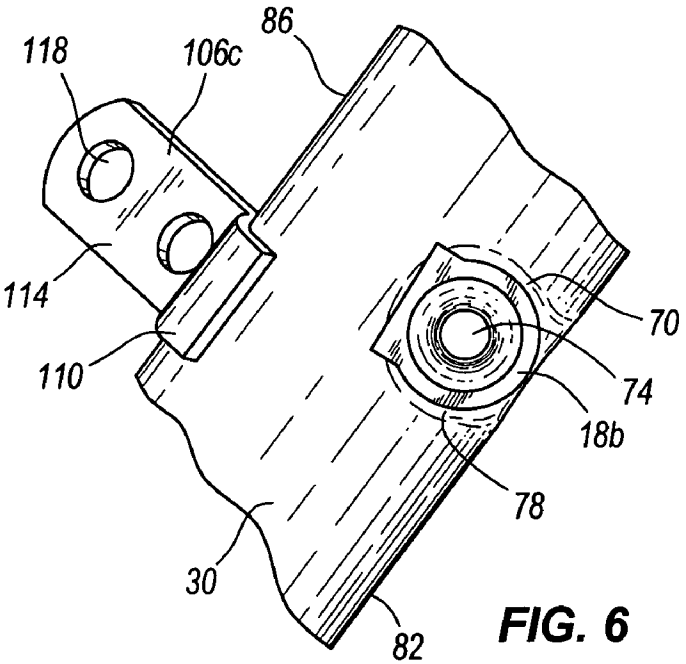
FIG. 6 illustrates a portion of the fuel rail, including a fuel injector cup and a mounting tab.

As illustrated in FIG. 4, a radius $R_1$ of the fuel rail 14 varies adjacent the fuel outlets 70 at the outer periphery 78 to compensate for high stress areas where the fuel outlets 70 are formed and the fuel injector cups 18 couple to the fuel rail 14. For example, the radius $R_1$ of the fuel rail 14 adjacent the fuel outlet 70 may be smaller or larger than a radius $R_2$ of the fuel rail 14 relative to an imaginary plane P (shown in FIG. 1). In further embodiments of the invention, a thickness of the sidewall 30 adjacent the fuel outlets 70 is greater than the thickness T of the sidewall 30 at the remaining portions to compensate for the high stress areas of the fuel rail 14.

A first end cap 90 is attached to the first end 38 of the fuel rail 14 and a second end cap 94 is attached to the second end 42 of the fuel rail 14 to enclose the chamber 34. In the illustrated embodiment, the first and second ends 38, 42 of the fuel rail 14 have substantially the same cross-sectional shape as the fuel rail 14, whereby the end caps 90, 94 have substantially the same cross-sectional shape as the fuel rail 14. In a further embodiment of the invention, the first and second ends 38, 42 have a different cross-sectional shape than the remainder of the fuel rail 14, such as circular, whereby the end caps 90, 94 will have substantially the same cross-sectional shape as the ends 38, 42 of the fuel rail 14. The end caps 90, 94 are attached to the fuel rail 14 by press-fitting the end caps 90, 94 to the first and second ends 38, 42 and laser welding the end caps 90, 94 to the fuel rail 14.

A fuel line tube 98 is attached to the first end cap 90 and is in communication with the chamber 34 of the fuel rail 14. The fuel line tube 98 provides a conduit for fuel from a fuel line (not shown) attached to a free end 102 of the fuel line tube 98 to the chamber 34 of the fuel rail 14. The fuel line tube 98 provides a quick connect to the fuel line. The fuel line tube 98 is press-fit to the end cap 90 and welded to the end cap 90. In a further embodiment of the invention, the fuel line tube 98 is attached along another portion of the fuel rail system 10, such as to the second end cap 94.

Mounting tabs 106 are attached to the sidewall 30 of the fuel rail 14 for coupling the fuel rail 14 onto an engine (not shown). The mounting tabs 106 are substantially S-shaped and include a base portion 110 for attachment to the fuel rail 14 and a flange portion 114 for attachment to the engine. The base portion 110 of the mounting tab 106 is spot-welded or tack welded to the sidewall 30 of the fuel rail 14, although other securing means known in the art may be employed. The flange portion 114 includes apertures 118 for receiving a fastener (not shown) to secure the fuel rail 14 to the engine. Any fastener known in the art may be used to secure the fuel rail 14 as described, for example, screws, nails, rivets, pins, posts, clips, clamps, inter-engaging elements, and any combination of such fasteners. In further embodiments of the invention, the flange portion 114 of the mounting tab 106 is welded to the engine or the mounting tab 106 has other shapes.

As illustrated in FIGS. 2 and 5, four mounting tabs 106 are secured to the fuel rail 14. Two mounting tabs 106*a* and 106*b* are positioned on the first side portion 82 of the fuel rail 14 and two mounting tabs 106*c* and 106*d* are positioned on the second, opposite side portion 86 of the fuel rail 14. The mounting tabs 106*c*, 106*d* positioned on the second side portion 86 of the fuel rail 14 are staggered relative to the mounting tabs 106*a*, 106*b* on the first side portion 82. In another embodiment of the invention, fewer or more mounting tabs 106 are secured to the fuel rail 14 or the mounting tabs 106 are arranged in other configurations on the bottom exterior surface 50 of the fuel rail 14, such as aligned on opposite sides of the fuel rail 14.

Figure 8:
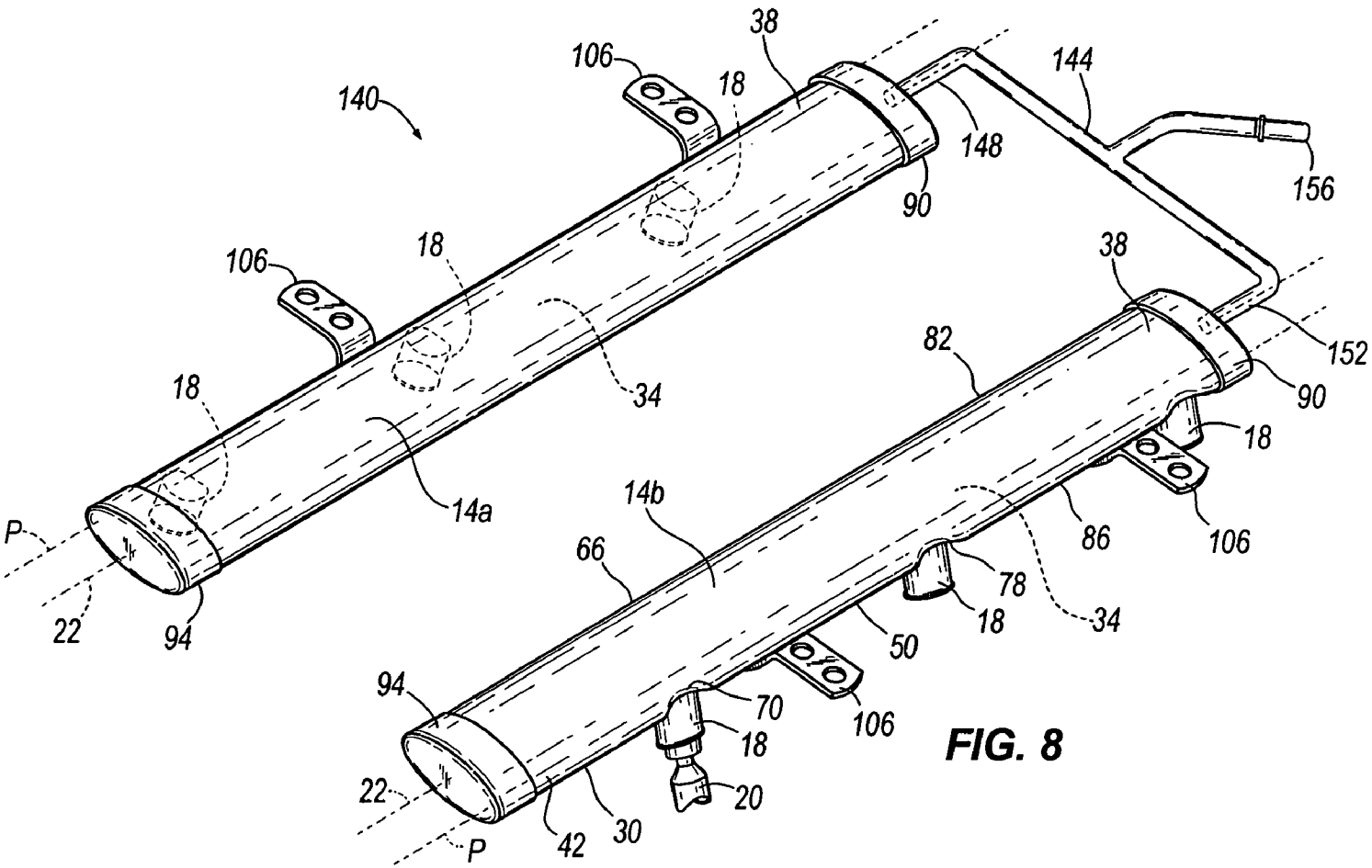
FIG. 8 is a perspective view of a dual fuel rail assembly embodying the invention.

FIG. 8 is a perspective view of a dual fuel rail assembly 140 for use in a fuel-injected internal combustion engine. The fuel rails illustrated in FIG. 8 are similar to the fuel rail 14 illustrated in FIGS. 1–7, therefore, like features are identified by the same numerals.

The fuel rail assembly 140 includes a two fuel rails 14*a* and 14*b*. A fuel conduit 144 communicates with the chamber 34 of the first fuel rail 14*a* and the chamber 34 of the second fuel rail 14*b*. The fuel conduit 144 provides a crossover between the two fuel rails 14*a*, 14*b*. A first end 148 of the fuel conduit 144 is attached to the first end cap 90 of the first fuel rail 14*a*, and a second end 152 of the fuel conduit 144 is attached to the first end cap 90 of the second fuel rail 14*b*. A fuel line tube 156 is attached to the fuel conduit 144 to direct fuel to the fuel rail assembly 140 through the fuel conduit 144. In further embodiments of the invention, those skilled in the art will recognize that the fuel line tube may be attached anywhere on the fuel rail assembly, including one of the fuel rails.

The fuel rails 14 illustrated in FIGS. 2–8 are for use with a six-cylinder fuel injected internal combustion engine. However, those skilled in the art will recognize that self-damping fuel rails are used with engines of various sizes and number of cylinders, used with fewer or more fuel injectors, and must accommodate a particular fuel pressure depending upon the design of engine system. Thus, depending upon the fuel-injected engine parameters, design of fuel rail will vary. For example, the ratio between the major and minor diameters of the cross-sectional shape of the fuel rail, the thickness of the fuel rail sidewall, and the radius of the fuel rail adjacent the fuel outlets are dependent upon the type and size of the engine in the system and the fuel pressure.

Various features of the invention are set forth in the following claims. For example, some fuel rail systems may require more than one self-damping fuel rail, fewer or more fuel injectors, or a flexible hose fuel conduit.

The invention claimed is:

1. A self-damping fuel rail for a fuel-injected internal combustion engine, the fuel rail comprising:

an elongated tube including a longitudinal axis, an overall length and a cross-sectional shape along a substantial portion of the length of the tube, the cross-sectional shape being a closed curve, wherein all portions of the cross-sectional shape curve outwardly from the longitudinal axis, and the shape having a non-constant radius, the tube having a major diameter, a minor diameter and a thickness, wherein a ratio between the major diameter and the thickness is greater than about 25:1; and at least one fuel outlet for communicating with a fuel injector.

2. The fuel rail of claim 1 wherein the tube is comprised of stainless steel.

3. The fuel rail of claim 1 wherein the tube has a sidewall and a substantial portion of the sidewall has a thickness between about 0.8 mm and about 1.5 mm.

4. The fuel rail of claim 1 and further comprising first and second end caps affixed to opposite ends of the tube.

5. The fuel rail of claim 1 and further comprising at least one mounting tab affixed to the tube for mounting the fuel rail onto an engine body.

6. The fuel rail of claim 1 wherein the radius of the tube varies adjacent the fuel outlet.

7. The fuel rail of claim 1 wherein the tube includes a first axis perpendicular to the longitudinal axis, the cross-sectional shape being symmetrical about the first axis.

8. The fuel rail of claim 7 wherein the tube includes a second axis perpendicular to the longitudinal axis and perpendicular to the first axis, the cross-sectional shape being symmetrical about the first and second axes.

9. The fuel rail of claim 8 wherein the cross-sectional shape is substantially elliptical.

10. A fuel supply system for a fuel-injected internal combustion engine, the fuel supply system comprising:

a self-damping fuel rail including a longitudinal axis and having a substantially elliptical cross-sectional shape, the fuel rail further including a thin-walled sidewall defining a chamber and first and seconds ends; and at least one fuel outlet formed in the sidewall for communicating with a fuel injector.

11. The fuel supply system of claim 10 and further comprising at least one fuel injector cup in communication with the fuel outlet of the fuel rail and the chamber.

12. The fuel supply system of claim 10 and further comprising a first end cap attached to the first end of the fuel rail and a second end cap attached to the second end of the fuel rail.

13. The fuel supply system of claim 10 and further comprising a fuel line tube in communication with the chamber.

14. The fuel supply system of claim 10 and further comprising at least one mounting tab attached to the sidewall of the fuel rail for mounting the fuel rail onto an engine.

15. The fuel supply system of claim 10 wherein the fuel rail is comprised of stainless steel.

16. The fuel supply system of claim 10 wherein a substantial portion of the tube sidewall has a thickness between about 0.8 mm and about 1.5 mm.

17. The fuel supply system of claim 16 wherein the thickness of the fuel rail adjacent the fuel injector is greater than the thickness of the remaining portions of the fuel rail.

18. The fuel supply system of claim 10 wherein the radius of the fuel rail varies proximate the fuel injector.

19. The fuel supply system of claim 10 wherein the fuel rail is a first fuel rail, the fuel supply system further comprising:

a second fuel rail including a longitudinal axis and having a substantially elliptical cross-sectional shape, the second fuel rail further including a sidewall defining a chamber and first and second ends;

at least one fuel outlet formed in the sidewall of the second fuel rail for communicating with a fuel injector; and a fuel conduit in communication with the chamber of the first fuel rail and the chamber of the second fuel rail.

20. The fuel supply system of claim 19, and further comprising a fuel line tube for directing fuel to the fuel supply system.

21. A method for fabricating a self-damping fuel rail for a fuel-injected internal combustion engine, the method comprising:

providing an elongated tube; and forming the tube to have a non-constant radius such that a cross-sectional shape of the tube is a closed curve, wherein all portions of the cross-sectional shape curve outwardly, the cross-sectional shape has a major diameter and a minor diameter and the formed tube has a thickness, and further wherein a ratio between the major diameter and the thickness is at least about 25:1.

22. The method of claim 21 wherein forming the tube comprises rolling the tube.

23. The method of claim 21 wherein forming the tube comprises flattening the tube.

24. The method of claim 21 wherein prior to forming the tube, the elongated tube has a circular shape.

25. The method of claim 21 wherein the cross-sectional shape is substantially elliptical.

26. The method of claim 21 and further comprising forming at least one fuel outlet in the tube for communicating with a fuel injector.

27. The method of claim 26 and further comprising varying the radius of the tube proximate the fuel outlet.

28. The fuel rail of claim 1 wherein the ratio between the major diameter and the thickness is less than about 55:1.

29. The fuel supply system of claim 10 wherein the fuel rail has a major diameter and a minor diameter, and further wherein a ratio between the major diameter and a thickness of the sidewall is at least about 25:1.

30. The fuel supply system of claim 10 wherein the thin-walled sidewall of the fuel rail absorbs pressure pulsations within the fuel rail to dampen the fuel rail.

31. The fuel supply system of claim 10 wherein a substantial portion of the sidewall has a thickness of at least 1.5 mm.

32. A self-damping fuel rail for a fuel-injected internal combustion engine, the fuel rail comprising:

an elongated, thin-walled tube including a longitudinal axis, an overall length and a cross-sectional shape along a substantial portion of the length of the tube, the cross-sectional shape being a closed curve, wherein all portions of the cross-sectional shape curve outwardly from the longitudinal axis, and the shape having a non-constant radius; and at least one fuel outlet for communicating with a fuel injector.

33. A fuel rail for a fuel-injected internal combustion engine, the fuel rail comprising:

an elongated tube including a longitudinal axis, an overall length and a cross-sectional shape along a substantial portion of the length of the tube, the cross-sectional shape being a closed curve, wherein all portions of the cross-sectional shape curve outwardly from the longitudinal axis, and the shape having a non-constant radius, wherein the tube is comprised of stainless steel; and at least one fuel outlet for communicating with a fuel injector.

34. A fuel rail for a fuel-injected internal combustion engine, the fuel rail comprising:

an elongated tube including a longitudinal axis, an overall length and a cross-sectional shape along a substantial portion of the length of the tube, the cross-sectional shape being a closed curve, wherein all portions of the cross-sectional shape curve outwardly from the longitudinal axis, and the shape having a non-constant radius, wherein the tube has a sidewall and a substantial portion of the sidewall has a thickness between about 0.8 mm and about 1.5 mm; and at least one fuel outlet for communicating with a fuel injector.

35. A method for fabricating a fuel rail for a fuel-injected internal combustion engine, the method comprising:

providing an elongated tube; and rolling the tube to have a non-constant radius such that a cross-sectional shape of the tube is a closed curve, wherein all portions of the cross-sectional shape curve outwardly.

* * * * *